US012098538B1

(12) United States Patent
Douglas

(10) Patent No.: US 12,098,538 B1
(45) Date of Patent: Sep. 24, 2024

(54) APPARATUS, SYSTEM, AND METHOD FOR A PARACLEAT ANCHOR FOR TILT-UP WALL CONSTRUCTION

(71) Applicant: JMR Technologies, Eureka Springs, AR (US)

(72) Inventor: Ben Douglas, Senoia, GA (US)

(73) Assignee: JMR Technologies, Eureka Springs, AR (US)

( * ) Notice: Subject to any disclaimer, the term of this patent is extended or adjusted under 35 U.S.C. 154(b) by 0 days.

(21) Appl. No.: 18/618,190

(22) Filed: Mar. 27, 2024

Related U.S. Application Data

(63) Continuation of application No. 18/309,251, filed on Apr. 28, 2023.

(51) Int. Cl.
*E04B 1/35* (2006.01)
*E04B 1/41* (2006.01)

(52) U.S. Cl.
CPC ..... *E04B 1/35* (2013.01); *E04B 1/4157* (2013.01); *E04B 2001/3588* (2013.01)

(58) Field of Classification Search
CPC ... E04B 1/16; E04B 1/167; E04B 1/35; E04B 1/4157; E04B 1/4107; E04B 2001/3588; E04B 2005/173; E04B 2005/322; E04C 5/12; E04G 11/365; E04G 15/061
See application file for complete search history.

(56) References Cited

U.S. PATENT DOCUMENTS 4,212,445 A * 7/1980 Hagen ..... A47B 88/43 248/245
5,050,364 A * 9/1991 Johnson ..... E04B 1/4157 D8/387
5,165,628 A * 11/1992 Todd ..... F16B 37/045 248/62
5,609,005 A * 3/1997 Schierloh ..... E04B 1/355 52/250
6,131,866 A * 10/2000 Kesinger ..... A47B 96/067 248/225.11
7,743,580 B2 * 6/2010 DeLoach, Sr. ..... E04B 1/41 52/701
7,814,710 B2 * 10/2010 Foglia ..... E04G 21/142 52/92.2

(Continued)

FOREIGN PATENT DOCUMENTS

DE 102018004529 A1 * 12/2019

*Primary Examiner* — Christine T Cajilig
(74) *Attorney, Agent, or Firm* — Shumaker, Loop & Kendrick, LLP; Patrick B. Horne

(57) ABSTRACT

An apparatus, system, and method for tilt-up construction using an anchor, a wood beam or other object, and a fastener for coupling the anchor to the object. The anchor is positioned proximate an interior surface of the wood beam and secured to the wood beam with the fastener. The wood beam is part of a wall form having one or more wall sections for defining an interior boundary for receiving a pourable substrate such as concrete. Once the concrete has been poured, the anchor is fixedly coupled to the wood beam. In alternate embodiments, a first fastener and a second fastener may be used to removably couple the second fastener to the first fastener in instances where the wood beam needs to be removed for certain types of tilt-up construction. In these embodiments, the first fastener is cast in the concrete, but is not fixedly coupled to the wood beam.

15 Claims, 6 Drawing Sheets

(56) References Cited

U.S. PATENT DOCUMENTS

| | | | | |
|---|---|---|---|---|
| 11,466,451 | B2 * | 10/2022 | Steinbicker | E04B 1/043 |
| 2007/0028552 | A1 * | 2/2007 | DeLoach | E04C 5/16<br>52/414 |
| 2007/0044392 | A1 * | 3/2007 | LeBlang | E04B 1/161<br>52/79.11 |
| 2010/0116359 | A1 * | 5/2010 | Ball | E04G 15/061<br>137/360 |
| 2014/0157718 | A1 * | 6/2014 | Fournier | E04B 2/90<br>52/707 |
| 2020/0399913 | A1 * | 12/2020 | Amend | E04B 2/8647 |

* cited by examiner

APPARATUS, SYSTEM, AND METHOD FOR A PARACLEAT ANCHOR FOR TILT-UP WALL CONSTRUCTION

CROSS-REFERENCE TO RELATED APPLICATION

This application is a continuation of and traces priority to U.S. patent application Ser. No. 18/309,251 filed Apr. 28, 2023, entitled APPARATUS, SYSTEM, AND METHOD FOR A PARACLEAT ANCHOR FOR TILT-UP WALL CONSTRUCTION, the entire contents of which are hereby incorporated by reference in its entirety.

TECHNICAL FIELD

The present disclosure relates to apparatuses, systems, and methods for using an anchor, and particularly a paracleat anchor, in tilt-up wall construction. More particularly, the present disclosure relates to parapet anchors for installation in concrete structures during fabrication of tilt-up walls that are tilted up into place and ultimately used to attach a roofing structure to form a building or warehouse.

BACKGROUND

Tilt-up construction is a technique that has been used since at least the early 1900s to cast concrete elements in a horizontal position and then tilt them up to a vertical position to create the final structure or wall. In general, tilt-up construction generally involves creating a form out of wood or other materials, placing one or more reinforcing components into the form such as steel reinforced bars (e.g., rebar), and pouring concrete into the form and over the reinforcing components. Typically, tilt-up panels are cast with the exterior of the panel facedown since the lifting hardware must be secured to the top face of the panel. Once cast and cured, the wood form is removed and the concrete panel is tilted up by a crane into position to form the wall of a building. In order to raise and lift the concrete panel into place, various anchors (e.g., lifting and bracing inserts) must be used.

Anchors may also be used to connect secondary framing components to the concrete panels, for installing a roof structure, for example. These anchors are used when coupling any other material to the concrete panel such as a sill plate or parapet wood blocking (e.g., a horizontal wood nailer). Common tilt-up construction connections fall into the following categories: (1) roof structure to panel; (2) supported floor structure to panel; (3) panel to slab on grade; (4) panel to footing; and (5) panel to panel. There are generally three types of anchors that may be used in tilt-up construction, as indicated by the International Building Code (IBC) Section 1901.3: (1) cast in place anchors (e.g., headed bolts, headed studs, and hooked J- or L-bolts); (2) post-installed (e.g., torque-controlled and displacement controlled, undercut, or screw anchors); and (3) adhesively attached post-installed anchors. There are also face-mounted anchors known in the art, where the structural framing sits on a seat attached to an embedded steel plate that has been cast into the face of the panel. Face-mounted connections, while compatible with continuous parapets, generally involve more pieces to fabricate and install, making them more costly overall.

Cast in place anchors are installed prior to the concrete being poured, but must be kept straight or straightened after the concrete has set for proper use. When installing the cast in place anchors, the J- or L-bolts, for example, must be affixed or installed through the wood blocking and prior to the concrete being poured/placed, so construction crews must work quickly to ensure each anchor is installed at the proper location with the correct spacing and ensure that each anchor is straight and plumb, all prior to the concrete hardening. If the cast in place anchor is not straight once the concrete has cured, it must be hammered into alignment, which may ultimately weaken the connection or damage the threads of the anchor. Thus, this process is time consuming and can be costly, as it must be done for every single anchor used in the concrete panel.

Post-installed anchors relieve the issue of maintaining accurate positioning of the connection since they are installed after the concrete has cured, but they require even more time and effort to install. For example, when installing this type of anchor, a hole must be drilled in the concrete panel and the hole must be cleaned out of any debris to ensure proper fastening (i.e., via a wire brush and vacuum, compressed air, etc.). Next, the sill plate or parapet wood blocking is placed into position and a hole is drilled in the wood that aligns with the hole in the concrete. Once this has been done, the screw or expansion bolt can be installed to couple the wood to the concrete panel. Since this type of anchor is installed after the concrete is cured, there is no longer the risk of misplacement. However, post-installed anchors require several components and an extensive amount of time to install, making them more costly overall.

Finally, post-installed adhesive anchors have been used, but similar to the post-installed anchors discussed above, a hole must first be drilled and cleaned prior to installation of the adhesive anchor. After the hole is drilled and cleaned, epoxy or other suitable adhesive is poured into the hole and the anchor is installed into the epoxy-filled hole.

Therefore, improvements are needed in anchors for tilt-up construction that minimize cost, number of components required, and overall time of installation.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

According to at least one embodiment, a tilt-up construction method using an anchor assembly includes the following steps: (1) laying a wall form having one or more wall sections in a predetermined configuration, where the predetermined configuration is configured to create an interior boundary for receiving a pourable substrate; (2) arranging one or more structural supports within the wall form; (3) coupling an anchor assembly to at least one of the one or more wall sections, where the anchor assembly includes (i) an anchor, and (ii) an attachment device, where coupling the anchor assembly to the at least one of the one or more wall sections further includes coupling the anchor to the at least one of the one or more wall sections proximate the interior boundary; (4) introducing a pourable substrate into the wall form interior boundary; and (5) allowing the pourable substrate to cure until it hardens forming a concrete panel, where the anchor assembly and the at least one of the one or more wall sections are fixedly coupled to the concrete panel.

In example embodiments, an anchor assembly for concrete panels used in tilt-up construction includes an anchor, a nailer strip, a first fastener, and a second fastener. The nailer strip has an outer surface and an opposing inner surface. The anchor is coupled to the nailer strip when the first fastener is coupled to the second fastener and the anchor is coupled to the nailer strip by the first fastener proximate the nailer strip inner surface and the nailer strip is releasably coupled to the anchor by the second fastener proximate the nailer strip outer surface.

In at least one embodiment, an anchor system for concrete panels used in tilt-up construction includes an anchor, a wood beam having an outer surface and an inner surface, and a fastener. The anchor is coupled to the wood beam by the fastener proximate the wood beam inner surface.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate some, but not all, embodiments and features as briefly described below. The summary and detailed descriptions, however, are not limited to only those embodiments and features explicitly illustrated.

DETAILED DESCRIPTIONS

Figure 1:
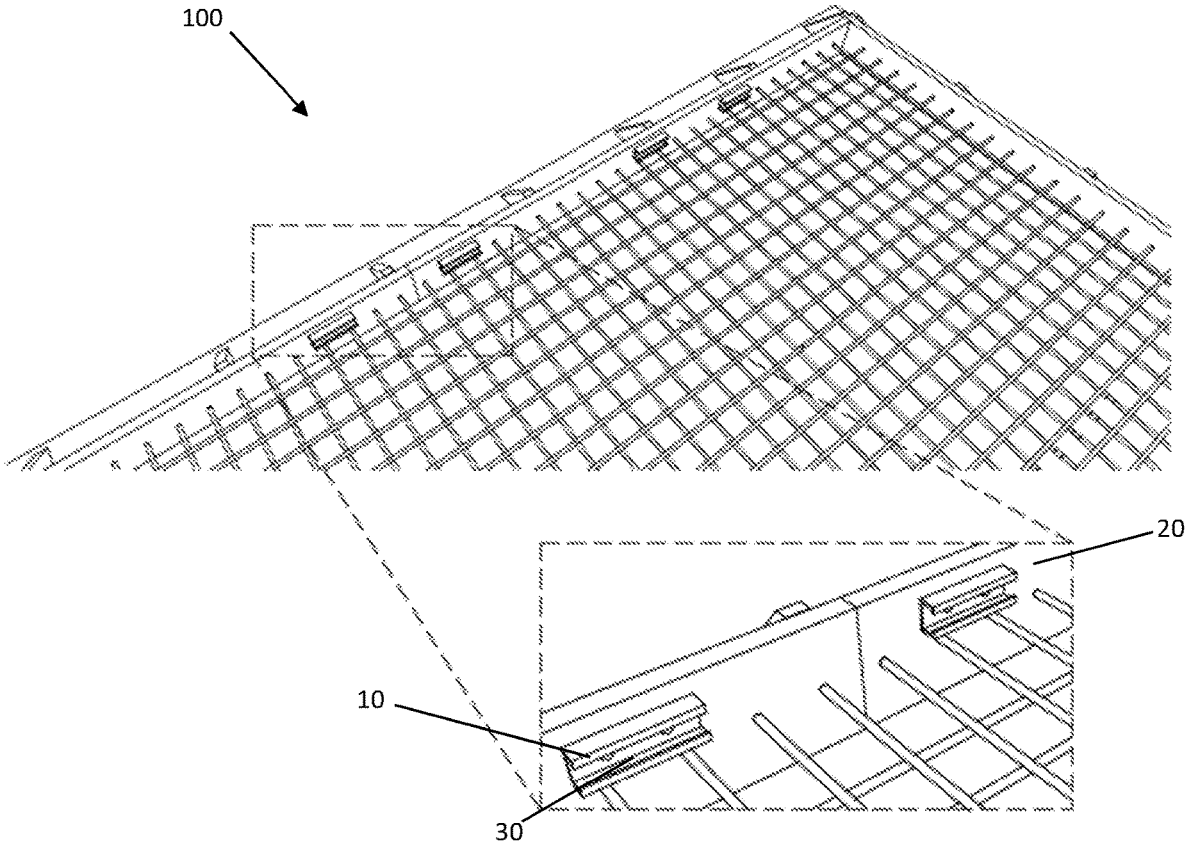
FIG. 1 is a perspective view of an anchor assembly according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a," "an," and "the" refer to "one or more" when used in the subject specification, including the claims. Unless indicated to the contrary, the numerical parameters set forth in the instant specification and attached claims are approximations that can vary depending upon the desired properties sought to be obtained within the scope of these descriptions.

An anchor system 100, according to at least one embodiment, is shown in FIGS. 1-7. The anchor system includes an anchor or cleat 10, an object 20 intended to be coupled to the anchor such as a wood nailer/beam, form, or sill plate, and a fastener 30 for coupling the object to the anchor 10. In some embodiments, concrete 40 that has been poured and cured over the anchor 10 and fastener 30 is included in the anchor system 100. However, the anchoring system 100 may be used in any suitable form or type of construction to anchor an object 20 to any other suitable substrate.

Anchor systems 100, such as the one described below, may be used in tilt-up construction to assist in lifting a panel of concrete 50 and/or securing an object 20 to the concrete panel. For example, as understood in the art, when coupling a roofing structure to a tilt-up concrete panel, a pressure-treated wood nailer must be coupled to the top surface of the panel 50 in order to receive a fastener for coupling the roofing structure. In the present embodiment, an object 20 such as a pressure-treated wood nailer may be installed using the anchor 10 prior to the concrete being poured to create the tilt-up panel 50. This eliminates both time and effort during construction. Furthermore, pouring the concrete after the anchor 10 has been installed and coupled to the wood 20 creates a strong connection that is required for a concrete anchor without the necessity to perform any additional steps as may be required with other types of concrete anchors.

Similarly, in buildings that are configured such that an upper section of the tilt-up concrete panel forms a parapet (i.e., a low protective wall along the edge of a roof that extends above the roof-line), wood blocking is typically installed at the top of the parapet for later coupling to flashing and a coping system, as required to prevent moisture from entering the building. However, as described above, prior methods of installing the wood blocking or pressure-treated wood nailer are time-consuming, require multiple parts, and can be quite costly. Therefore, the present anchor system 100 provides the anchoring capability and low-cost nature of a cast in place anchor, while maintaining the accurate positioning found with post-installed anchors, only with less risk of error than cast in anchors and lower cost and fewer parts than post-installed anchors.

Figure 5:
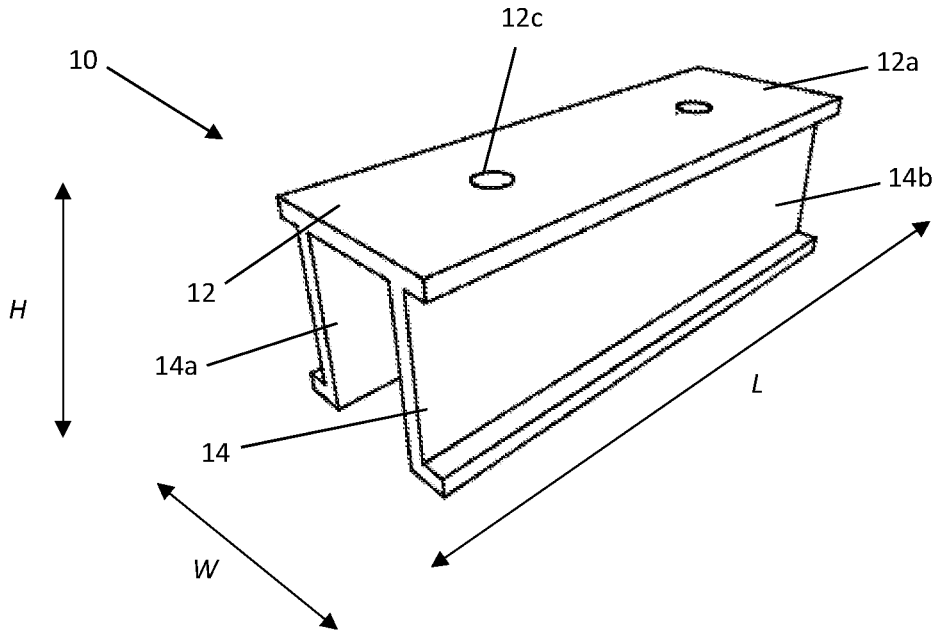
FIG. 5 is a perspective view of the anchor assembly of FIG. 1.
Figure 6:
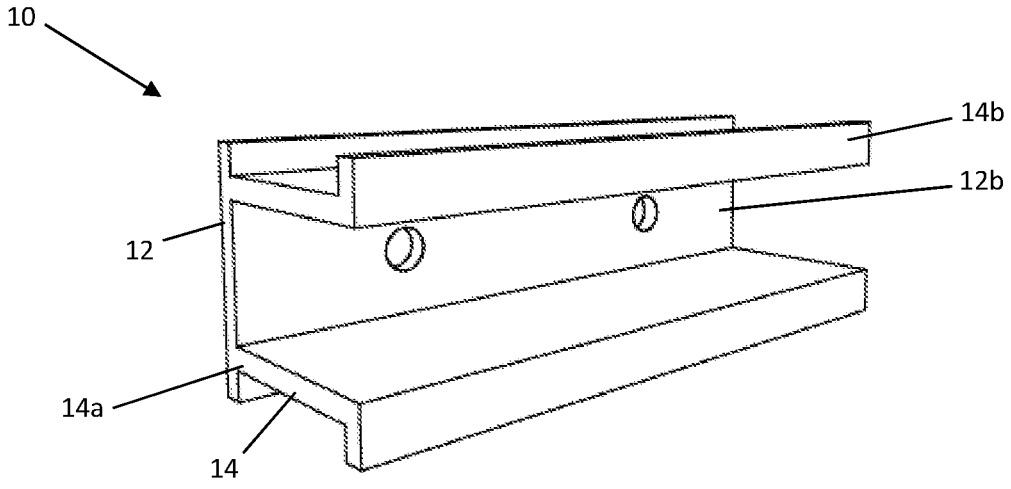
FIG. 6 is a bottom perspective view of the anchor assembly of FIG. 1.
Figure 7:
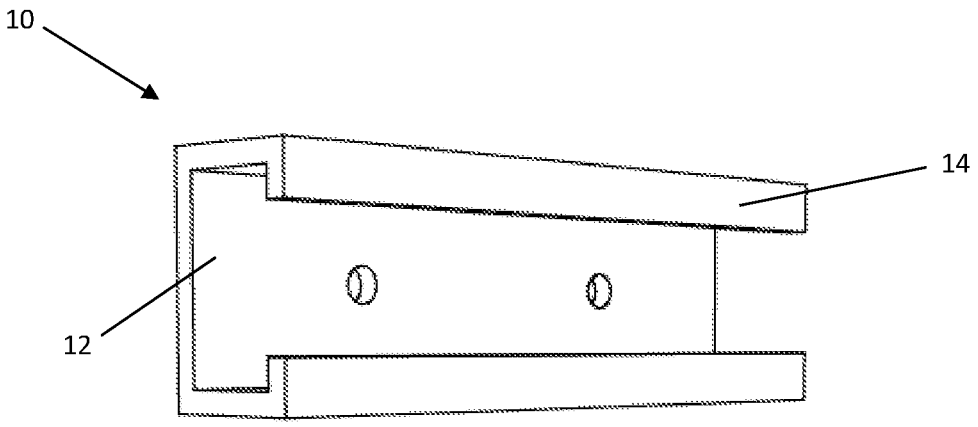
FIG. 7 is a bottom perspective view of the anchor assembly of FIG. 3.

Referring to FIGS. 5-7, the anchor or cleat 10 includes an upper structural portion or part 12 and a lower structural portion or part 14. When used proximate a parapet, the anchor is a paracleat anchor. The cleat 10 is a projecting piece, that when installed in the anchoring system 100, furnishes a grip to provide strength to the system and to hold or support the various components in position when installed. In example embodiments, the anchor 10 is longer than it is wide. Conversely, the anchor 10 may be wider than it is long. In example embodiments, the overall length L of the anchor 10 is between about 1 inch to about 12 inches, more preferably about 2 inches to about 8 inches, for example about 2 inches to about 6 inches. The overall width W of the anchor 10 is between about one inch to about six inches, more preferably about two inches to about four inches, for example about two inches. The overall height H of the anchor, according to example embodiments, is between about one inch to about six inches, more preferably about two inches to about four inches, for example about two inches. In particular embodiments, the cross-section of the anchor 10 is approximately two inches by two inches, thereby effectively creating a square cross-section. In alternate embodiments, the width of the cross-section of the anchor 10 may be less than or greater than the height of the cross-section of the anchor. In various embodiments, the anchor 10 is installed with its length perpendicular to the wood nailer or object 20. In some embodiments, the anchor 10 may be installed with its length parallel to the object. In still other embodiments, the placement of the anchor 10 with respect to the object 20 may be any suitable direction.

When viewed from the side, as shown in FIG. 5, the anchor 10 gives the overall general impression of the "n" symbol. In alternate embodiments, as show in FIG. 7, the anchor 10 may be C-shaped. In some embodiments, the anchor 10 cross-section is generally U-shaped. For example, as shown in FIGS. 5-7, the upper structural portion 12 includes a substantially flat upper surface 12*a* and the lower structural portion 14 has a first leg portion 14*a* and a second leg portion 14*b* extending down from bottom surface 12*b* of the upper structural portion. In example embodiments, the upper structural portion 12 and the lower structural portion 14 may be integrally formed or separately formed and then coupled together prior to being used in the anchoring system 100.

In various embodiments, the upper structural portion 12 flat surface 12*a* allows the anchor 10 to be entirely or substantially entirely flush with the bottom surface of an object 20 that it is intended to couple with, such as a pressure treated wood beam/form, nailer strip, etc. Keeping the anchor flush with the wood beam, for example, conserves energy and keeps the costs of heating and cooling to a minimum. This configuration also prevents water from penetrating the structure between the anchor and the beam. In some embodiments, a layer of insulation may be installed intermediate the object 20 and the anchor 10 to further prevent heat transfer.

Generally, the upper structural portion 12 is shaped and sized to be smaller than the wood or other object 20 intended to couple to the anchor 10. In alternate embodiments, the anchor may extend farther than a perimeter of the object 20 for visual effect or for other mechanical reasons. In example embodiments, the underside 12*b* of the upper structural portion is also substantially flat. However, in various embodiments, the underside 12*b* may have a textured surface for better adhering to the concrete or other substrate once it is poured or introduced into the wood form.

FIG. 5 depicts a perspective view of the anchor having a width W, height H, and a length L. According to example embodiments, the lower structural portion 14 of the anchor 10 has a first leg portion 14*a* and a second leg portion 14*b* that when coupled fixedly to the upper structural portion 12 create a generally U-shaped recess. The first leg portion 14*a* and the second leg portion 14*b* are generally mirror images of each other. In alternate embodiments, the first leg portion 14*a* and the second leg portion 14*b* may not be mirror images of each other to create a stronger bond with the concrete making it more difficult for the anchor 10 to be removed from the concrete or to shift position inadvertently within the cured or hardened substrate. In various embodiments, the first leg portion 14*a* has a generally J-shaped cross-section and the second leg portion 14*b* has a generally L-shaped cross-section. In particular embodiments, the first and second leg portions 14*a*, 14*b* may be any suitable shape to help secure the anchor 10 in the concrete once it has been poured and cured around the anchor.

Figure 2:
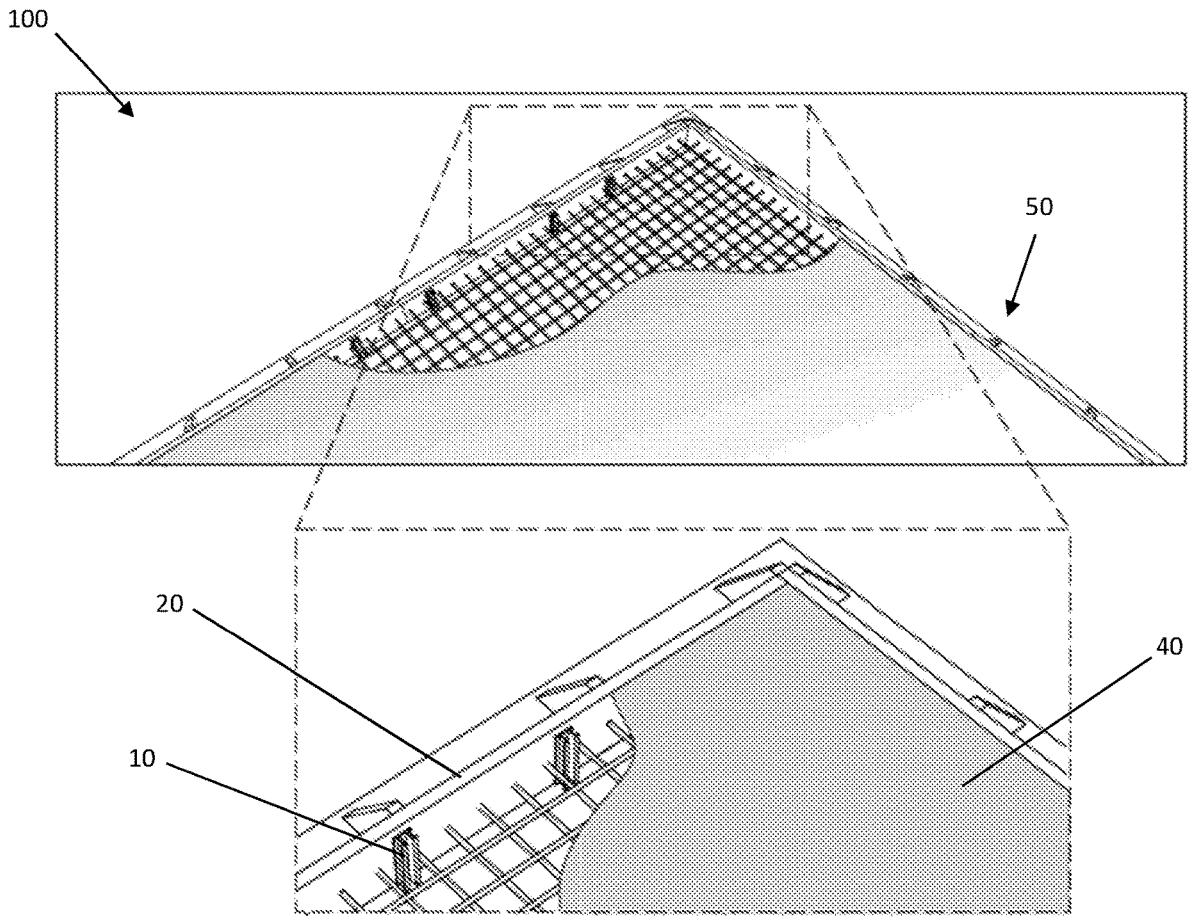
FIG. 2 is perspective view of the anchor assembly of FIG. 1, according to various embodiments of the anchor assembly including poured concrete.
Figure 3:
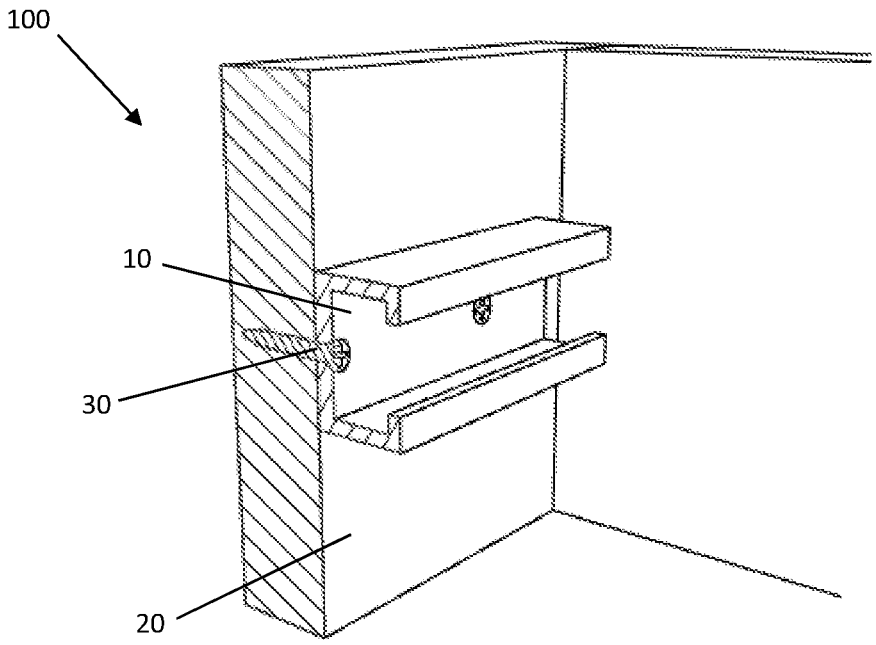
FIG. 3 is a perspective view of an alternate embodiment of the anchor assembly of FIG. 1.
Figure 4:
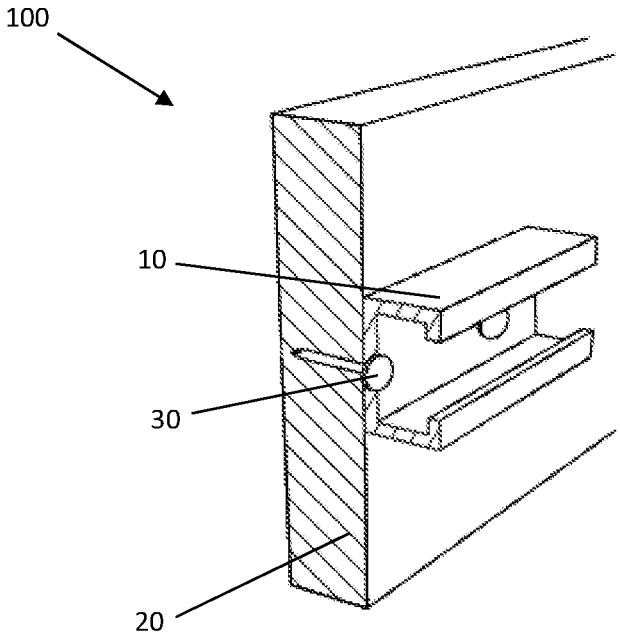
FIG. 4 is a perspective view of an alternate embodiment of the anchor assembly of FIG. 1.

As shown, the shape of the first and second leg portions 14*a*, 14*b* is similar to a typical J-bolt or L-bolt currently used in the art. However, with the present embodiment, there is not the need to later straighten or align the anchor as required with these prior bolts because the anchor 10 is fastened directly to the pressure treated wood. Furthermore, rather than being a singular cylinder that may easily succumb to gravitational forces, wind uplift, out-of-plane wind, seismic in-plane wind, and other seismic forces, the length L of the first and second leg portions 14*a*, 14*b* creates a more secure bond since more surface area is covered and held in place by the cured concrete, as shown in FIG. 2. Similar to the upper structural portion 12, while shown with generally straight/flat edges, the lower structural portion 12 may have any suitable texture for better contact and coupling with the masonry, which is generally not an entirely smooth substrate. In addition, while concrete is referenced throughout, any suitable substrate may be used. Moreover, while the anchor 10 is described with regard to tilt-up construction, the anchor may be used in any type of construction or other project where an anchoring mechanism may be required.

In example embodiments, the anchor 10 may be constructed from any suitable material (e.g., stainless steel, plastic, polymer, metal, composite material, and/or the like) and made using molding or other conventional techniques and equipment (e.g., extrusion molding, injection molded, blow molded, compression molding, rotational molding, thermoforming, 3D printing, casting, etc.). In various embodiments, the anchor 10 is formed from a high tensile plastic. In some embodiments, the anchor 10 may be formed from a recycled plastic. In particular embodiments, the anchor 10 is formed from a substantially rigid material. In some embodiments, the anchor 100 may be formed from a less rigid material (e.g., plastic or recycled plastic). In embodiments where the anchor 10 has at least some flexibility, the possibility for stress corrosion cracking ("SCC") is lessened as compared to anchors made from stainless steel, which are prone to SCC, especially in particularly cold environments. The flexible, resilient material permits minor movement of the anchor during, for example, an earthquake, limiting the likelihood of the roof or other connected structure from disconnecting from the vertical wall and/or preventing the roofing structure from collapsing. This type of anchor thereby prevents the cracking that might occur with known anchors from a combination of mechanical loading, chemical interactions, and other conditions present as a result of the use of concrete.

In example embodiments, any suitable object 20 may be coupled to the anchor 10 prior to the concrete or other substrate being introduced. In various embodiments, the object 20 is a wood nailer, wood blocking, steel plate, or a sill plate. In some embodiments, the object 20 may be another concrete panel, in which case the additional panel would need to be drilled and cleaned, as discussed with post-installed anchors, and the fastener 30 would need to be compatible with the hole formed in the additional panel.

In particular embodiments, the fastener 30 may be any suitable fastener, including but not limited to, a screw, bolt, rivet, nail, adhesive, etc. In example embodiments, the fastener 30 may be formed of any suitable, durable material such as stainless steel, plastic, polymer, metal, composite material, and/or the like. In some embodiments, the fastener 30 may be removable from the anchoring system 100. In preferred embodiments, the fastener is fixedly coupled to the anchoring system 100 by aligning the anchor 10 to an interior surface of the object 20, and securing or driving the fastener through the anchor and into the object. In alternate embodiments, the fastener 30 may be secured or driven through the exterior surface of the object 20 and then into the anchor 10. In particular embodiments, once installed, the fastener 30 does not extend all the way through the object 20 that is coupled to the anchor 10. In alternate embodiments, the fastener 30 may extend through the object 20 in various instances where the object may need to be removed from the concrete panel 40, as discussed further below. In particular embodiments, more than one fastener 30 may be used to couple the object 20 to the anchor 10. For example, in embodiments where the anchor 10 is installed parallel to the object 20, two fasteners 30 may be used to keep the anchor aligned with the object.

Figure 8:
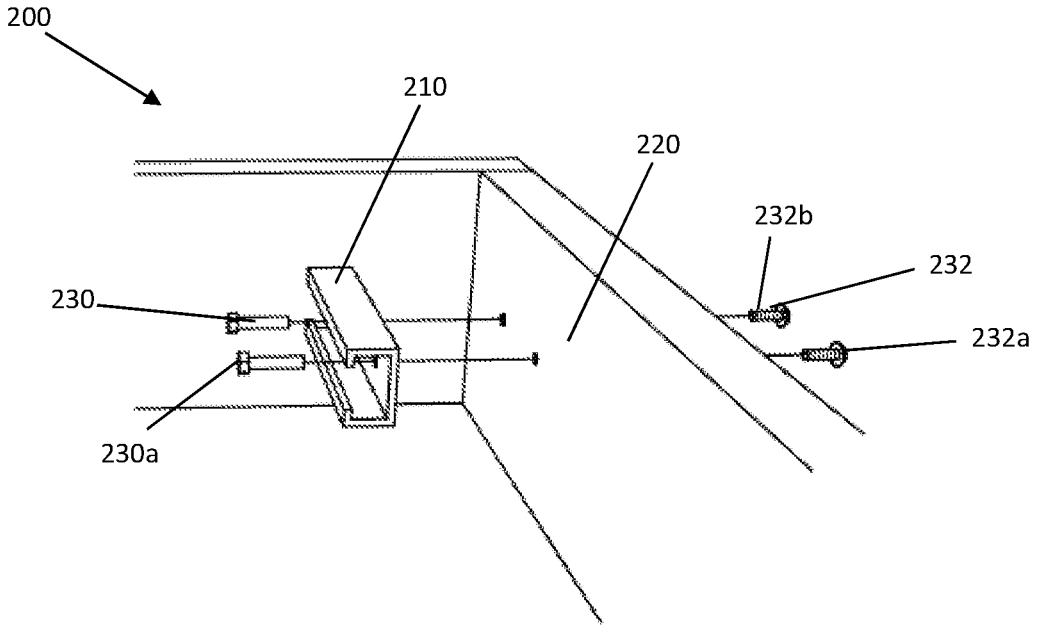
FIG. 8 is a perspective, exploded view of an anchor assembly according to another example embodiment of the invention.
Figure 9:
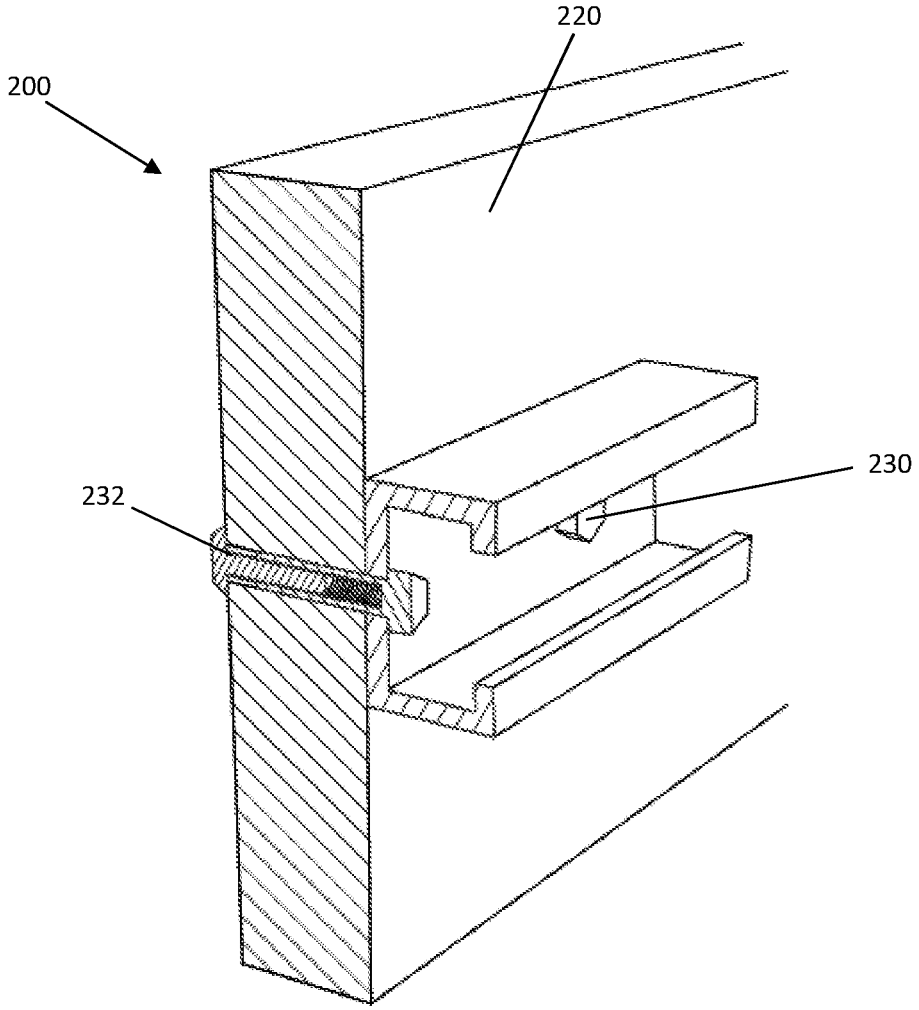
FIG. 9 is a perspective view of the anchor assembly of FIG. 8.

FIGS. 8-9 illustrate an alternate embodiment anchoring system 200. Many features described with reference to the anchoring system 200 illustrated in FIGS. 8-9 are the same or similar to the features of the anchoring system 100 illustrated in FIGS. 1-7. Thus, for purposes of ease of understanding and clarity, only certain features will be discussed to highlight the differences in the anchoring system 200 shown in FIGS. 8-9 as compared to the embodiment shown in FIGS. 1-7.

In example embodiments, the anchoring system 200 includes an anchor 210, an object 220, a first fastener 230, and a second fastener 232. In particular embodiments, the anchoring system 200 includes two or more first fasteners 230 and two or more second fasteners 232. The anchoring system 200 is beneficial in situations where the top nailer plate, or pressure treated wood plate 220 needs to be removed for any number of reasons including for crane access. Thus, the anchoring system 200 is installed in the same way as the anchoring system 100 of FIGS. 1-7 but includes a second, removable fastener 232. This system may be beneficial when the concrete panel 50 is tilted or lifted up from the top surface rather than from the interior, exposed surface.

In particular embodiments, the first fastener 230 is configured for removably receiving and coupling to the second fastener 232. In some embodiments, the outer surface of the first fastener is knurled to provide a textured surface for gripping to the concrete or other substrate better. The first fastener 230, similar to the fastener 30 of the anchoring system 100 described above, is coupled to the wood or other object 220 through the anchor 210 on an interior surface of the object. The second fastener or bolt 232 is then releasably coupled to the first fastener 230 proximate an outer surface of the object 220, allowing the object or wood form to be easily coupled and decoupled, and then re-coupled to the anchoring system 200.

In particular embodiments, the first fastener 230 generally includes a head portion or knob 230*a* and a stem portion 230*b*. The head portion 230*a* is generally annularly shaped and the stem portion 230*b* is tubular, having a threaded bolt engaging recess. In various embodiments, the second fastener 232 includes a head portion 232*a* and a stem portion 232*b*. The stem portion 232*b* of the second fastener 232, in particular embodiments, is a threaded stem having threads that correspond to the threaded bolt engaging recess for releasably coupling the second fastener to the first fastener 230. In alternate embodiments, any similarly releasable fastening mechanism may be used.

A method of using the anchor system 100, according to example embodiments, includes the following steps.

The first step, is to lay the wood form 20 for receiving poured concrete that will ultimately be cured to create a concrete panel 50. Once the wood 20 has been positioned and secured into a fully enclosed form, a reinforcing structure 22 such as rebar is placed within the form. In alternate embodiments, any suitable reinforcing structure may be used. Before or after positioning the reinforcing structure 22, one or more anchors 10 are secured to the wood frame proximate to where the top of the panel will be once the panel has been tilted up. The one or more anchors 10 are secured to the wood frame 20 via one or more fasteners 30 or coupling mechanisms (e.g., screw, bolt, nail, or the like).

After all anchors 10 have been placed in their appropriate location and secured to the wood frame 20, the concrete may be poured and left to cure. In some embodiments, the concrete is poured to cover just the reinforcing structure, but not to the top of the wood form, to allow for insulating material to be placed on the poured concrete, and then more concrete is poured on top of the insulating layer and allowed to cure or harden. When the concrete is poured and smoothed over such that it aligns with the top perimeter of the wood frame 20, the concrete will be left to cure, causing the anchors 10 to be cast in place in the concrete, while still being coupled to the wood frame at the top of the concrete panel. This makes the process of coupling other objects to the wood frame such as wood blocking or roofing material much simpler, faster, and more cost efficient because the wood nailer is already installed securely in place. In other embodiments where the alternate anchoring system 200 is used, the first fastener 230 will be cast in the cured concrete, but the second fastener 232 will still be removable to remove the wood form for lifting the concrete panel 50 from its top edge or surface 50*a*.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A tilt-up construction method, the method comprising, laying a wall form having one or more wall sections in a predetermined configuration, wherein the predetermined configuration is configured to create an interior boundary for receiving a pourable substrate;

arranging one or more structural supports within the wall form;

coupling an anchor assembly to at least one of the one or more wall sections, wherein the anchor assembly comprises:

an anchor comprising a first leg and a second leg that both extend along a length of an attachment portion and project outward from the attachment portion; and one or more attachment devices;

wherein coupling the anchor assembly to the at least one of the one or more wall sections further comprises coupling, using the one or more attachment devices, the attachment portion of the anchor to the at least one of the one or more wall sections proximate the interior boundary such that the first leg and the second leg project outward and perpendicular to the at least one of the one or more wall sections;

introducing a pourable substrate into the wall form interior boundary such that the pourable substrate encloses around the first leg and the second leg; and allowing the pourable substrate to cure until it hardens forming a solid panel, wherein the anchor assembly and the at least one of the one or more wall sections are fixedly coupled to the solid panel.

2. The method of claim 1, wherein the attachment device is selected from the group consisting of a screw, a nail, and a bolt.

3. The method of claim 1, wherein the attachment device is a screw.

4. The method of claim 1, wherein the one or more structural supports comprise at least one of reinforcing steel or rebar material.

5. The method of claim 1, wherein coupling the anchor assembly to the at least one of the one or more wall sections proximate the interior boundary further comprises the steps of:

driving the attachment device through the attachment portion of the anchor and into the at least one of the one or more wall sections; and securing the attachment device to the at least one of the one or more wall sections.

6. The method of claim 1, the method further comprising:

coupling one or more second attachment devices to the one or more attachment devices, wherein the one or more second attachment devices are releasably coupled to the attachment devices proximate an exterior boundary of the wall form.

7. The method of claim 6, wherein the one or more attachment devices comprise a threaded inner surface and the one or more second attachment devices comprise a threaded outer surface complementary to the attachment threaded inner surface of the one or more attachment devices for releasably coupling the one or more second attachment devices to the one or more attachment devices.

8. The method of claim 1, wherein the pourable substrate is concrete.

9. An anchor assembly for concrete panels in tilt-up construction, the anchor assembly comprising:

an anchor comprising a first leg and a second leg that both extend along a length of an attachment portion and project outward from the attachment portion;

a nailer strip, wherein the nailer strip has an outer surface and an opposing inner surface;

a first fastener; and a second fastener, wherein the attachment portion of the anchor is coupled to the nailer strip when the first fastener is coupled to the second fastener, wherein the anchor is coupled to the nailer strip by the first fastener proximate the nailer strip inner surface and the nailer strip is releasably coupled to the anchor by the second fastener proximate the nailer strip outer surface.

10. The anchor assembly of claim 9, wherein the first fastener comprises a threaded inner surface and the second fastener comprises a threaded outer surface complementary to the first fastener threaded inner surface.

11. The anchor assembly of claim 9, wherein the first leg, the second leg, and the attachment portion of the anchor are configured such that a U-shaped recess is formed therebetween, wherein when coupled, the nailer strip and the U-shaped recess are configured to create an interior boundary for receiving a pourable substrate.

12. The anchor assembly of claim 9, wherein the nailer strip comprises a wood beam having a length greater than its width.

13. An anchor system for concrete panels used in tilt-up construction, the anchor system comprising:

an anchor comprising a first leg and a second leg that both extend along a length of an attachment portion and project outward from the attachment portion;

a wood beam, wherein the wood beam has an outer surface and an inner surface; and one or more fasteners;

wherein the attachment portion of the anchor is coupled to the wood beam by the one or more fasteners proximate the wood beam inner surface such that the first leg and the second leg project outward and perpendicular to the wood beam;

wherein the anchor system further comprises one or more second fasteners, wherein the one or more second fasteners are releasably coupled to the one or more fasteners proximate the wood beam outer surface;

wherein the one or more fasteners comprise a threaded inner surface and the one or more second fasteners comprise a threaded outer surface complementary to the threaded inner surface of the one or more fasteners for releasably coupling the one or more second fasteners to the one or more fasteners.

14. The anchor system of claim 13, wherein the first leg, the second leg, and the attachment portion of the anchor are configured such that a U-shaped recess is formed therebetween, wherein when coupled, the wood beam and the U-shaped recess are configured to create an interior boundary for receiving a pourable substrate.

15. A tilt-up construction method, the method comprising, laying a wall form having one or more wall sections in a predetermined configuration, wherein the predetermined configuration is configured to create an interior boundary for receiving a pourable substrate;

arranging one or more structural supports within the wall form;

coupling an anchor assembly to at least one of the one or more wall sections, wherein the anchor assembly comprises:

an anchor; and one or more attachment devices comprising a threaded inner surface;

wherein coupling the anchor assembly to the at least one of the one or more wall sections further comprises coupling, using the one or more attachment devices, the anchor to the at least one of the one or more wall sections proximate the interior boundary by attaching at least one other attachment device to the one or more attachment devices, wherein the at least one other attachment device comprises a threaded outer surface complementary to the threaded inner surface of the one or more attachment devices, the at least one other attachment device being releasably coupled to the one or more attachment devices proximate an exterior boundary of the wall form;

introducing a pourable substrate into the wall form interior boundary; and allowing the pourable substrate to cure until it hardens forming a solid panel, wherein the anchor assembly and the at least one of the one or more wall sections are fixedly coupled to the solid panel.

* * * * *